US011519328B2

(12) United States Patent
Lassesson et al.

(10) Patent No.: US 11,519,328 B2
(45) Date of Patent: Dec. 6, 2022

(54) METHOD FOR OPERATING AN INTERNAL COMBUSTION ENGINE

(71) Applicant: VOLVO TRUCK CORPORATION, Gothenburg (SE)

(72) Inventors: Bengt Lassesson, Gothenburg (SE); Fredrik Rahm, Hörby (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/954,078

(22) PCT Filed: Dec. 20, 2017

(86) PCT No.: PCT/EP2017/083801
§ 371 (c)(1),
(2) Date: Jun. 15, 2020

(87) PCT Pub. No.: WO2019/120511
PCT Pub. Date: Jun. 27, 2019

(65) Prior Publication Data

US 2021/0164389 A1 Jun. 3, 2021

(51) Int. Cl.
*F02B 75/00* (2006.01)
*F02B 75/02* (2006.01)

(52) U.S. Cl.
CPC ..... *F02B 75/021* (2013.01); *F02B 2075/028* (2013.01)

(58) Field of Classification Search
CPC ..... F02D 41/0057; F02D 39/04; F02B 1/04; F02B 53/02; F02B 75/02
See application file for complete search history.

(56) References Cited

U.S. PATENT DOCUMENTS 2,249,997 A * 7/1941 Wydler ..... F02B 75/021 123/1 R
4,641,613 A 2/1987 Delesalle
(Continued)

FOREIGN PATENT DOCUMENTS

| | | |
|---|---|---|
| CN | 1985081 A | 6/2007 |
| DE | 112005001795 T5 | 6/2007 |
| WO | 2017152997 A1 | 9/2017 |

OTHER PUBLICATIONS

International Search Report and Written Opinion dated Sep. 27, 2018 in corresponding International PCT Application No. PCT/EP2017/083801, 10 pages.
(Continued)

*Primary Examiner* — Long T Tran
(74) *Attorney, Agent, or Firm* — Venable LLP; Jeffri A. Kaminski

(57) ABSTRACT

The invention relates to a method (100) for operating an internal combustion engine (2), such as an internal combustion engine of a vehicle (1), the engine (2) comprising an engine cylinder (3) at least partly defining a combustion chamber (4) and a reciprocating piston (5), a number of inlet valves (20) in fluid communication with the combustion chamber and a number of exhaust valves (30) in fluid communication with the combustion chamber, wherein any one of the inlet valves and the outlet valves comprises at least one flow control valve. The method comprises the following steps: opening (105) at least one of the inlet valves and introducing the incoming fluid medium into the cylinder (3) of the engine by performing an intake stroke (S1); compressing (110) the trapped incoming fluid medium in a first compression stroke (CS1) of the cylinder (3), while having the number of the inlet valves and the number of the exhaust valves in a closed state; injecting (115) a quantity of fuel into the cylinder (3) and combusting said injected fuel; performing (120) a first work stroke (WS1) to produce power to a crank shaft of the engine, while controlling said
(Continued)

flow control valve to partly exhaust burnt gases at the end of the work stroke; additionally compressing (125) remaining fluid medium in an additional compression stroke (CS2) of the cylinder (3), while having the number of the inlet valves and the number of the exhaust valves in a closed state; additionally injecting (130) an additional quantity of fuel into the cylinder (3); additionally performing (135) an additional work stroke (WS2) to produce power to the crank shaft of the engine, while controlling said flow control valve to partly exhaust burnt gases at the end of the additional work stroke; and opening (180) at least one of the exhaust valves and permitting partly burnt gases to expel from the cylinder via said at least one exhaust valve by performing an exhaust stroke (ES).

14 Claims, 5 Drawing Sheets

(56) References Cited

U.S. PATENT DOCUMENTS

2003/0154964 A1* 8/2003 Gaessler ..... F02D 13/0273 123/90.11
2005/0205044 A1* 9/2005 Lewis ..... F02D 41/0002 123/198 F
2008/0098969 A1 5/2008 Reed et al.
2011/0017170 A1* 1/2011 Song ..... F02M 25/0227 123/25 C
2011/0251743 A1* 10/2011 Hu ..... F02D 13/0276 123/542
2014/0157758 A1* 6/2014 Silver ..... F01N 3/103 60/274
2014/0158100 A1 6/2014 Williams et al.
2014/0360473 A1* 12/2014 Sturman ..... F02D 41/3041 123/48 AA
2016/0040614 A1* 2/2016 Younkins ..... F02P 5/1512 123/335
2016/0131058 A1* 5/2016 Younkins ..... F02D 13/06 123/334
2017/0157758 A1 6/2017 Howe

OTHER PUBLICATIONS

China Office Action dated Oct. 8, 2021 in corresponding China Patent Application No. 201780097818.1, 6 pages.

* cited by examiner

METHOD FOR OPERATING AN INTERNAL COMBUSTION ENGINE

CROSS-REFERENCE TO RELATED APPLICATIONS

This application is a U.S. National Stage application of PCT/EP2017/083801, filed Dec. 20, 2017, and published on Jun. 27, 2019, as WO 2019/120511 A1, all of which is hereby incorporated by reference in its entirety.

TECHNICAL FIELD

The invention relates to a method for operating an internal combustion engine. By way of example, the invention relates to a method for operating an internal combustion engine of a vehicle. In particular, the invention relates to a method for operating an extended four stroke internal combustion engine of a vehicle. The invention also relates to an internal combustion engine comprising a control unit for performing a method of operating the engine.

The invention is applicable on various types of vehicles, in particular heavy-duty vehicles, such as trucks, buses, construction equipment, working machines e.g. wheel loaders, articulated haulers, dump trucks, excavators and backhoe loaders etc. Although the invention will mainly be described in relation to a truck, the invention is not restricted to this in particular, but may also be used in other vehicles such as working machines. The invention may also be applied in any other type of internal combustion engine for power generation, e.g. in a system comprising an internal combustion engine and a generator for power generation.

BACKGROUND

Ordinary reciprocating internal combustion engines, e.g. diesel combustion engines, are normally optimized for operations at medium to high engine loads. However, operations at part load or low load conditions are inevitably in many driving situations, and such conditions may for instance frequently occur when a vehicle engine is left idling. By way of example, a waste collection vehicle may frequently operate the engine on part load or low load when collecting municipal solid waste and hauling the collected waste to a solid waste treatment facility. Running a diesel engine under low loads may cause lower cylinder pressures as well as poor piston ring sealing since this relies on the gas pressure to force them against the oil film on the bores to form the seal. Further, low cylinder pressures typically cause poor combustion and thus lower combustion pressures and lower temperatures. A poor combustion may for instance cause aggregation of unburned fuel in the cylinder. It has also been observed that other fluid mediums such as the incoming pressurized air may not be fully utilized for combustion of the fuel. In other words, the cycle of the engine is not performed in an efficient manner when operated on part load or low load.

In this context, U.S. Pat. No. 4,641,613 discloses a process for improving the starting and low-load running of a diesel engine. The process involves controlling the valves and injection in a manner that, in at least some of the cylinders of the engine, several successive compression strokes are performed with the valves closed and without fuel injection. In particular, it discloses that the injector and the valves should be kept closed during at least one further expansion/compression cycle. In this manner, it is believed that the air within the cylinder can be heated up to an ignition temperature enabling ignition of the fuel.

Despite the activity in the field, there remains a need for an improved operation of a vehicle internal combustion engine on part load or low load. In particular, it would be desirable to further enhance the conventional operational cycle of a vehicle diesel engine to facilitate prolonged periods of running at low speeds and/or on low loads.

SUMMARY

An object of the invention is to provide a more efficient method of operating an internal combustion engine, such as a diesel internal combustion engine, on part load or low load, in which the utilization of the fluid medium, or fluid mediums, involved in the combustion process is improved. The object is at least partly achieved by a method according to claim 1.

According to a first aspect of the present invention, there is provided a method for operating an internal combustion engine of e.g. a vehicle. The engine comprises an engine cylinder at least partly defining a combustion chamber and a reciprocating piston operable between a bottom dead center and a top dead center, a number of inlet valves in fluid communication with the combustion chamber and configured to regulate the supply of an incoming fluid medium to the combustion chamber and a number of exhaust valves in fluid communication with the combustion chamber and configured to regulate the evacuation of exhaust gases from the combustion chamber. Moreover, any one of the inlet valves and the outlet valves comprises at least one flow control valve adapted to regulate the flow of a fluid medium passing through the flow control valve, the method comprises the following steps:

- opening at least one of the inlet valves and introducing the incoming fluid medium into the cylinder of the engine by performing an intake stroke;
- compressing the trapped fluid medium in a first compression stroke of the cylinder, while having the number of the inlet valves and the number of the exhaust valves in a closed state;
- injecting a quantity of fuel into the cylinder and combusting the injected fuel;
- performing a first work stroke to produce power to a crank shaft of the engine, while controlling the flow control valve to partly exhaust burnt gases at the end of the work stroke, thereby reducing the pressure in the cylinder;
- additionally compressing remaining fluid medium in an additional compression stroke of the cylinder, while having the number of the inlet valves and the number of the exhaust valves in a closed state;
- additionally injecting an additional quantity of fuel into the cylinder;
- additionally performing an additional work stroke to produce power to the crank shaft of the engine, while controlling the flow control valve to partly exhaust burnt gases at the end of the additional work stroke, thereby reducing the pressure in the cylinder; and
- opening at least one of the exhaust valves and permitting partly burnt gases to expel from the cylinder via the at least one exhaust valve by performing an exhaust stroke.

By the steps of the method according to the example embodiments, it becomes possible to increase the engine operating range towards a lower torque range, which will allow the engine to operate continuously rather than intermittently. For example, when driving in a situation where the needed brake torque is above zero, but rather low (e.g. when driving in downhill terrain), adding the additional compression stroke and the additional working stroke will increase the engine operating range towards a lower torque range, which enables the engine to operate continuously rather than intermittently. In other words, the steps of performing the additional compression stroke and the additional working stroke according to the provisions above allows for improving the utilization of the incoming fluid medium, e.g. air, flowing through the internal combustion engine on part load or low load. This is an advantage in situations when the vehicle engine is operated on part load or low load and different to current conventional prior art methods for operating an engine, in which the main part of the intake air in the cylinder is not fully utilized for combustion of the fuel. Thus, a lot of air is supplied through the internal combustion engine, which typically causes pump losses etc. In addition, if a throttle is employed to lower the air flow into the engine, it may often increase the pressure difference over the engine. Rather, the example embodiments of the method provides for a increased utilization of the captured air during the intake stroke by introducing e.g. additional combustion strokes as mentioned above.

The example embodiments of the method are particularly useful when the vehicle internal combustion engine is operated on low load at idle speed, which sometimes may also be referred to as an ultra low load engine operation.

Further, by having at least one flow control valve as mentioned above, it becomes possible to introduce a short exhaust burst at the end of the work stroke to reduce the forthcoming compression work. Moreover, by using a flow control valve, it becomes possible to provide an enhanced level of freedom of operation without causing pump losses etc.

To this end, the example embodiments provides a method capable of extending the operational range of the engine towards lower torque, which has hitherto not been possible during normal four stroke operation. Moreover, the method provides for delaying the gas exchange compared to other prior art system in that the supplied air can be utilized in a number of compression strokes and work strokes. In addition, the example embodiments contribute to increasing the efficiency at part load by reducing e.g. the pump loss during gas exchange by increasing the utilization of the intake air. As such, the example embodiments provide a method for operating an internal combustion engine that more effectively utilizes the air flowing through the engine, thus reducing the pump losses in the system. An additional advantage of implementing the method as described above, is that less idle air will flow through the after treatment equipment. Thus, also the cooling effect on the exhaust aftertreatment system (EATS) may be reduced. As such, the need for additional heating of the catalyst decreases, which will have a positive impact on the overall consumption of fuel of the vehicle.

Without the exhaust burst between the work stroke and the compression stroke, the pressure and the temperature in the cylinder will reach unfavourable levels from exhaust gas composition point of view and harmful levels from a mechanical point of view. Further, without the exhaust burst and thus the pressure release, the compression stroke will consume the work produced during the previous work stroke. Thus, the step of controlling the flow control valve to partly exhaust burnt gases at the end of the first work stroke and at the end of the additional work stroke(s) ensure that a minor exhaust burst can be performed to permit the generated pressure in the cylinder to decrease to a lower level. That is, by the step of making a minor exhaust burst, the engine system is operated to release a minor amount of air and fuel at each and every work stroke in the cycle.

In addition, this part of the step of the method contributes to reduce the pressure and temperature in the cylinder. Further, it is believed that operating the engine according to the method of the example embodiments contributes to a smoother operation of the vehicle.

The example embodiments of the method may also be applicable on other types of internal combustion engines intended for power generation, vessel power propulsion and the like, but also in various hybrid systems including an internal combustion engine. Thus, the example embodiments may e.g. be used in various types of genset applications, including diesel generators, a combination of diesel engine and electric generator etc. Further, the example embodiments of the method may also be incorporated in other types of engine-generators, as well as in railway locomotives, vessels, ferries, pumps such as water pumps etc. Typically, such systems may include a diesel internal combustion engine and a generator operatively connected to the engine.

The invention is typically useful in driving situations in which the vehicle is occasionally or frequently operated at idle speed, e.g. in city traffics. The difference in pressure created in such situations causes the engine to power more than is required, which means that more fuel is exhausted than there is power generated.

Typically, the method is adapted to operate at least once per cylinder and engine revolution.

The method according to the example embodiments is particularly useful on a supercharged engine.

It should be noted that although the method is typically intended for a diesel type engine, i.e. a diesel type combustion, the fuel provided for the combustion may in some example embodiments be provided for a premixed combustion, where the fuel may be injected directly into the cylinder or into an air upstream of the cylinder, e.g. by port injection.

Further, it is to be noted that the method may also be used in an Otto-cycle engine, or a hybrid engine system of a diesel engine and an Otto-cycle engine.

There are several different possibilities to provide the flow control valve and the valve can either be implemented as one of the valves of the inlet valves or as one of the valves of the outlet valves. Independently of the location and arrangement of the flow control valve, the valve is adapted to regulate the flow of a fluid medium passing through the flow control valve. The flow control valve can be controlled in various manners. Typically, although not strictly necessary, the flow control valve comprises an actuator operatively connected to a valve member, wherein the actuator is configured to operate the valve member by means of pneumatic pressure. Hence, in some example embodiments, the flow control valve is a pneumatic flow control valve. As such, each valve member has its own actuator controlling the valve position and timing. However, in other example embodiments, a number of valve members may be controlled by common actuator.

The actuator is typically configured to control the opening and closure of the valve member at a given point in time. By way of example, the actuator is typically configured to control the opening and closure of the valve member at a given point in time by receiving a signal from a control unit or the like.

In addition, the flow control valve may also be a lift valve member configured to regulate the height of the lift valve opening.

In one example embodiment, one of the inlet valves is a flow control valve.

In addition, or alternatively, one of the exhaust valves is a flow control valve. In this manner, it becomes possible to operate the exhaust valve in an efficient and fast manner resulting in an exhaust burst that reduces the residual pressure at the end of the work stroke, which is unfavourable during the forthcoming compression stroke.

Typically, although not strictly necessary, the method further comprises repeating some of the steps until the quantity of the remaining fluid medium in the cylinder is below a threshold value. In particular, the method may comprise repeating the steps of additionally compressing remaining fluid medium in an additional compression stroke of the cylinder, while having the number of the inlet valves and the number of the exhaust valves in a closed state; additionally injecting an additional quantity of fuel into the cylinder; and additionally performing an additional work stroke to produce power to the crank shaft of the engine, while controlling the flow control valve to partly exhaust burnt gases at the end of the additional work stroke, thereby reducing the pressure in the cylinder, until the quantity of the remaining fluid medium in the cylinder is below a threshold value.

In some example embodiments, the step of partly exhausting burnt gases at the end of the work stroke is performed close to or at the bottom dead center. The step of partly exhausting burnt gases at the end of the work stroke may also be performed close to or at the bottom dead center and at sonic flow.

Also, it is to be noted that in the step of performing the first work stroke to produce power to the crank shaft of the engine, the flow control valve is typically in the closed state. Accordingly, the number of the inlet valves and the number of the exhaust valves are maintained in their closed state, respectively, when performing the first work stroke to produce power to the crank shaft of the engine.

Analogously, it is to be noted that in the step of performing the additional work stroke to produce power to the crank shaft of the engine, the flow control valve is typically in the closed state. Accordingly, the number of the inlet valves and the number of the exhaust valves are maintained in their closed state, respectively, when performing the additional work stroke to produce power to the crank shaft of the engine.

According to some example embodiments, the method further includes the step of using the burnt gases to propel a turbo charger.

Typically, although not strictly required, the step of partly exhausting burnt gases at the end of the work stroke is performed by controlling a valve parameter relating to any one of valve opening size, valve opening timing, valve opening duration, flow area, flow time, valve lift or a combination thereof.

According to one example embodiment, the step of partly exhausting burnt gases at the end of the work stroke is performed by utilizing only one flow control valve of the group of the exhaust valves and the group of intake valves.

The other valves of the groups of valves not being provided as flow control valves are typically check valves, non-return valves or the like. These types of valves may for instance be provided as conventional poppet type valves.

According to one example embodiment, each valve in the group of valves is a flow control valve, and the method is configured to utilize each one of the valves in the group of the exhaust valves. By way of example, each one of the valves of the group of exhaust valves is a flow control valve, and the step of partly exhausting burnt gases at the end of the work stroke is performed by utilizing each one of the flow control valves in the group of the exhaust valves.

By providing a configuration in which each one of the valves of the group of exhaust valves is a flow control valve, it becomes possible to independently regulate each one of the valves. As such, the regulation of the fluid medium and the engine system can be further improved in terms of e.g. flexibility.

It is to be noted that the number of flow control valves, and the configuration of each valve and the configuration of the number of valves typically depends on the type of installation of the example embodiments, e.g. type of vehicle, type of engine etc.

It is also to be noted that the flow control valve may also be provided by another type of flow control valve than the pneumatic flow control valve. Thus, the flow control valve may be any one of an electro-magnetic flow control valve, a pneumatic flow control valve, an electro-pneumatic flow control valve, a hydraulic flow control valve, an electro-hydraulic flow control valve or the like.

Typically, although not strictly required, the step of partly exhausting burnt gases at the end of the work stroke is performed by controlling an actuator operatively connected to a valve member of the flow control valve, the valve member being adapted to regulate a valve opening upon a signal from the actuator. The valve member is typically regulated to control the opening, closure, timing and flow area of the valve opening. The actuator is typically configured to control the opening and closure of the valve member at a given point in time. By way of example, the actuator is typically configured to control the opening and closure of the valve member at a given point in time by receiving a signal from a control unit or the like.

By way of example, the valve member is any one of a rotational valve member and a lift valve member.

In some example embodiments, the intake stroke comprises the step of displacing the piston from the top dead center of the cylinder to the bottom dead center of the cylinder, while maintaining at least one inlet valve open during at least a part of the time the piston being displaced from the top dead center to the bottom dead center.

In some example embodiments, the step of compressing the trapped fluid medium in the first compression stroke of the cylinder is performed by displacing the piston from bottom dead center of the cylinder to top dead center of the cylinder.

According to a second aspect of the present invention, there is provided an internal combustion engine which comprises a control unit for controlling the internal combustion engine. The control unit is configured to perform the steps of the method according to any one of the example embodiments and/or the features as described above in relation to the first aspect of the present invention.

Effects and features of the second aspect are largely analogous to those described above in relation to the first aspect of the present invention.

It should be noted that the control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device.

As mentioned above, the control unit may be a digital control unit, however, the control unit may also be an analog control unit.

In addition, the control unit may be configured to control each one of the valves, in particular the control unit may be configured to control each one of the flow control valves of the system.

According to a third aspect of the present invention, there is provided a vehicle comprising an internal combustion engine and a control unit as described above in relation to the second aspect of the present invention.

According to a fourth aspect of the present invention, there is provided a computer program comprising program code means for performing the steps described above in relation to the first aspect of the present invention when the program is run on a computer.

According to a fifth aspect of the present invention, there is provided a computer readable medium carrying a computer program comprising program means for performing the steps described above in relation to the first aspect of the present invention when the program means is run on a computer.

Effects and features of the third, fourth and fifth aspects are largely analogous to those described above in relation to the first aspect of the present invention.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

Figure 1A:
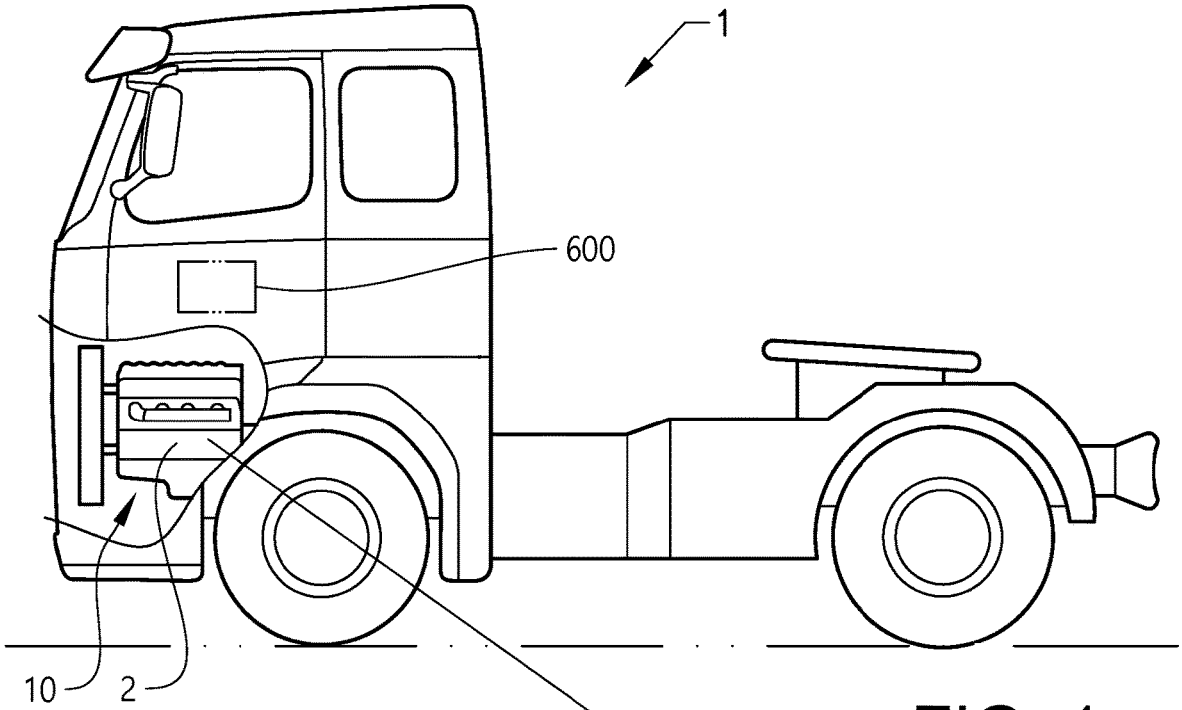
FIG. 1*a* is a side view of a vehicle in the form of a truck comprising an internal combustion engine system adapted to be operated according to a method of an example embodiment of the present invention.

With reference to the appended drawings, below follows a more detailed description of embodiments of the invention cited as examples.

DETAILED DESCRIPTION OF EXAMPLE EMBODIMENTS OF THE INVENTION

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

FIG. 1*a* is a side view of a vehicle in the form of a truck, or a tractor for a semitrailer. It should be noted that the vehicle can be of a variety of alternative types, e.g. it may be a car, a bus, or a working machine such as a wheel loader or the like.

Figure 1B:
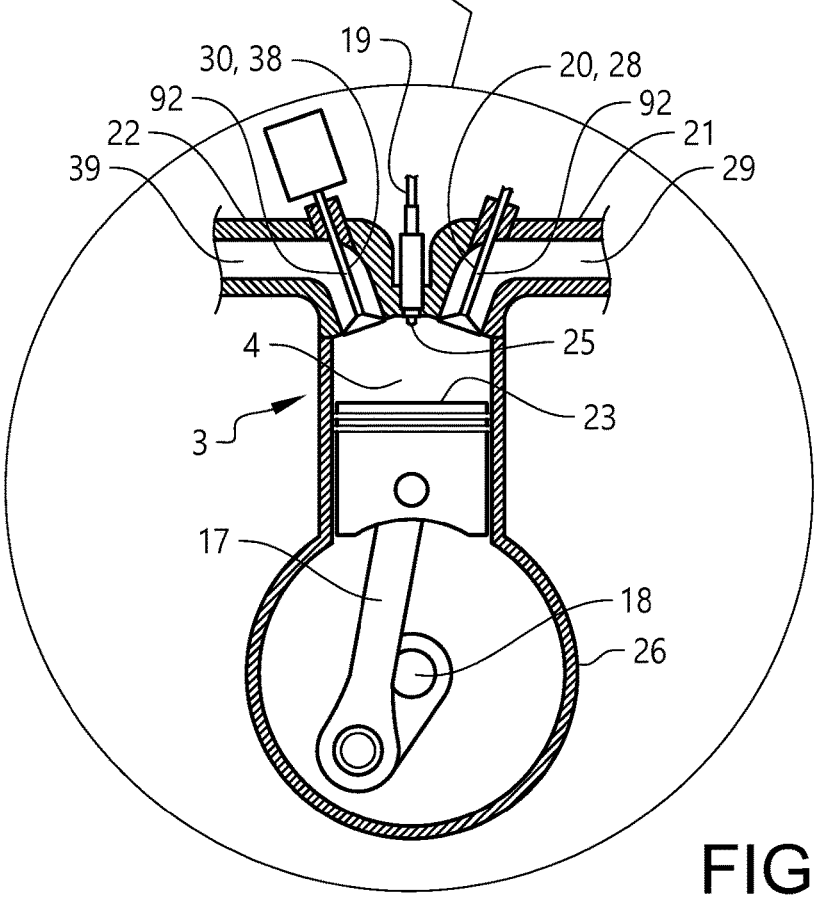
FIG. 1*b* is a schematic drawing of an internal combustion engine system in the vehicle in FIG. 1.

The vehicle 1 in FIG. 1*a* comprises an internal combustion engine system 10 adapted to be operated according to a method of an example embodiment of the present invention. The internal combustion engine system 10 comprises an internal combustion engine 2 also adapted to be operated according to a method of an example embodiment of the present invention, as described below in more detail. One cylinder of the engine in FIG. 1*a* and further components of the engine system are described in further detail with reference to FIG. 1*b*, FIGS. 2*a*-2*i*, FIG. 3 and FIG. 4. FIG. 1*b* is a schematic drawing of parts of the engine, in particular a drawing of parts of the cylinder in the vehicle in FIG. 1*a*.

In addition, in this example, the internal combustion engine system 10 comprises a control unit 600 to perform the operational steps of the method according to the example embodiments as described herein, and which are further described in relation to FIGS. 2*a*-2*i* and 3. In other designs of the system and the vehicle, the control unit may be arranged in another remote location of the vehicle. Thus, the vehicle may comprise the control unit.

Turning again to FIG. 1*a*, the heavy-duty truck 1 comprises the internal combustion engine system 10, including the internal combustion engine 2. The engine is e.g. an extended four-stroke internal diesel combustion engine. However, the internal combustion engine may well be implemented also in other types of vehicles, such as in busses, in light-weight trucks, cars etc. By way of example, the internal combustion engine system 10 comprises a compression ignition internal combustion engine 2. The internal combustion engine 2 may be e.g. a diesel engine, which as such may be running on several different types of fuel, such as diesel or dimethyl ether, DME. Other fuel types may also be conceivable, such as a renewable fuel as well as hybrid systems comprising an internal combustion engine and an electrical motor.

The internal combustion engine in FIGS. 1*a* and 1*b* is designed to work according to the diesel process. Since the components of an internal combustion engine are well-known, and the function and configuration of the engine can vary dependent on the type of vehicle, only a brief introduction of the engine will be described for the sake of a better understanding on how the method of the example embodiments can be installed in the internal combustion engine of a vehicle, such as a truck. Accordingly, although not shown in the figures, the engine may generally comprise the cylinder and a piston 23, which reciprocates in the cylinder and is connected to a crankshaft so that the piston is set to reverse in the cylinder at an upper and lower dead centre position. As is also common, one end of the cylinder cavity is closed by an engine cylinder head, which is further described hereinafter.

In other words, the internal combustion engine system 10 is provided with at least one engine cylinder 3. Typically, the internal combustion engine system includes a plurality of cylinders, e.g. six to eight cylinders 3, each one having a reciprocating piston member 23, as described in more detail in relation to FIG. 1*b*.

Thus, each cylinder 3 comprises a corresponding reciprocating piston 23, which may be of any type which is suitable for compression ignition. The cylinder 3 is only described in general terms since its parts and functionality is well known in the art. The cylinder configuration may be e.g. straight, V-shaped or any other suitable kind. Each cylinder 3 of FIG. 1*b* comprises at its vertical top end at least one and typically a multiple number of inlet channels 21 for inlet air, and at least one and typically a multiple number of outlet channels 32 for exhaust gases from the fuel combustion process taking place within the cylinder 3. Each inlet channel 21 has an inlet valve 20 for controlled inlet of inlet air, and each outlet channel 32 has an outlet valve 30 for controlled outlet of exhaust gases. Located centrally in the cylinder 3, between the inlet channel(s) 21 and the outlet channel(s) 22 there is an injection valve 19 arranged, which at its tip has a fuel injector 25. Thus, in order to inject fuel into a combustion chamber of a combustion engine cylinder of the internal combustion engine, the engine typically comprises the fuel injector. However, it should be readily appreciated that the engine may include a plurality of injectors for injecting fuel into a combustion chamber of a combustion engine cylinder. The location and direction of the injection valve 19 may be of other kinds, such as located slanting to one side and positioned towards a side wall of the cylinder 3. The piston 23 is connected to a connection rod 17, which in turn is connected to a crankshaft 18. The crankshaft 18 is located within a crankcase 26. The combustion causes the piston 23 to reciprocate between its uppermost position, a so called top dead center, TDC, and its lowermost position, the bottom dead center, BDC. In FIG. 1*b* the piston 23 is located close to its BDC. The volume within the cylinder 3 between the BDC of the piston 23 and the cylinder top is called the combustion chamber 4. This is where i.a. combustion of fuel takes place. In this example, as will be described further hereinafter, the internal combustion engine system 10 works according to the well-known four-stroke principle. However, the combustion engine may in other examples work according to the equally well-known two-stroke principle.

The piston is provided in its upper surface with a piston bowl, which forms the combustion chamber together with an inner surface of the cylinder head and walls of the cylinder. In other words, a combustion interface is formed between the combustion chamber and the cylinder head. It should also be noted, although not shown in the FIGS. of the example embodiments, that the piston typically has a piston crown. The piston crown has a piston surface which comprises the whole surface which faces the combustion chamber 4 of the cylinder 3. In the example depicted in FIG. 1*b*, the piston crown has a centrally located piston bowl, which is rotationally symmetrically designed in relation to the piston as a whole. The piston bowl may be designed as a recess or depression in the piston crown. The piston bowl may also have a centrically located elevation, which highest portion however is lower than the remainders of the piston crown. The piston bowl has a piston bowl surface and is surrounded by a circumferential rim portion which delimits the piston bowl from the remainders of the piston crown. From the highest portion of the central elevation of the piston bowl, the piston bowl surface slants generally straight towards the bottom portion, at which bottom portion the piston bowl surface again raises generally straight and rather steeply towards the circumferential rim portion. The remainders of the piston crown, to the outside of the circumferential rim portion, are generally flat. This configuration of the piston bowl is sometimes referred to as a "Mexican hat".

The layouts of the cylinder 3 and of the piston 23 may be otherwise designed than the one disclosed herein. For example the piston 23 may be designed having a non-rotationally symmetrical cylindrical configuration to correspond to a non-cylindrical configuration of the devices at the top of the cylinder 3. The fuel injector 25 may be located towards the side of the top of the cylinder 3 and from such a location direct fuel spray plumes into the cylinder 3 in a slanting manner. The fuel injector 25 may furthermore direct one or several slightly flattened rather than circular fuel spray plume(s) 3 towards the combustion chamber and the piston 23. Further, the piston bowl 28 may be non-rotationally symmetrical, shallower and/or having a smaller diameter. It may also have a circumferential rim portion which has a smaller radius of curvature and a smaller elevation, if any one at all. As such, it should be readily appreciated that the example embodiments of the invention as described herein can be implemented in several different designs, both with respect to the engine as such, but also with respect to the cylinder design and the other components of the engine. The internal combustion engine generally refers to an engine in which the combustion of a fuel (normally a fossil fuel) occurs with an oxidizer (usually air) in a combustion chamber. However, as mentioned above, it is to be noted that the example embodiments of the invention may also be implemented in an internal combustion engine in which the fuel is a renewable fuel.

Turning now to FIGS. 2*a*-2*i*, which schematically illustrate a number of operational steps in a method according to an example embodiment of the present invention, there is depicted a number of operational steps in order to fulfill an extended four stroke cycle. As will be readily understood from the description with reference to FIGS. 2*a*-2*i* and 3, one of the effects of the present invention is to improve the operation of the engine at part load or low load.

As mentioned above, the method according to any one of the example embodiments as described with references to FIGS. 2*a*-2*i* and 3 can be installed in the internal combustion engine as described above in relation to FIGS. 1*a*-1*b*, or in any other engine of a vehicle.

Reference is now made to FIGS. 2*a*-2*i* in which one of the cylinders 3 in a multi-cylinder engine 2 according to an example embodiment of the invention is depicted. Each of FIGS. 2*a*-2*i* shows the cylinder in a respective stroke of a repeated cycle of the cylinder, described further hereinafter. As mentioned above, the engine 2 comprises the engine cylinder 3 at least partly defining the combustion chamber 4. Further the engine comprises the reciprocating piston 5 operable between the bottom dead center and the top dead center. Each cylinder 3, which is provided with the piston 23, as mentioned above, is connected to the crankshaft 17 housed in the crankcase 26.

Moreover, the engine includes the number of inlet valves 20 being in fluid communication with the combustion chamber 4 and configured to regulate the supply of an incoming fluid medium to the combustion chamber 4. The fluid medium is a working fluid medium and typically refers to a premixed working fluid medium that may contain air, fuel, burnt gases, other combustion influencing fluid mediums and/or a mixture thereof. In this example, the incoming fluid medium is air. In particular, the incoming fluid medium is pressurized air. As will be further described herein, at least one of the inlet valves 20 is a flow control valve 28 adapted to regulate the flow of a fluid medium passing through the flow control valve. One example of a flow control valve is described in relation to FIG. 4 below. The flow control valve 28 can be controlled in various manners. Typically, although not strictly necessary, the valve comprises an actuator 91 operatively connected to a valve member 92 and configured to operate the valve member by means of a pneumatic pressure. The actuator is typically configured to control the opening and closure of the valve member at a given point in time. By way of example, the actuator is typically configured to control the opening and closure of the valve member at a given point in time by receiving a signal from the control unit or the like. Hence, in this example embodiment, the flow control valve is a pneumatic flow control valve. Further, each one of the inlet valves is provided in the form of a flow control valve. That is, each inlet valve 20 is a flow control valve 28 adapted to regulate the flow of a fluid medium passing through the flow control valve. This example of the valve is also schematically depicted in FIG. 1*b* and FIG. 4. If the flow control valve is a pneumatic flow control valve, each one of the flow control valves is typically in fluid communication with a common air compressor (not shown), or a corresponding separate air compressor, being configured to supply compressed air to the corresponding flow control valve(s).

The engine further comprises in each cylinder 3 the exhaust valve 30 arranged to control a communication between the respective cylinder 3 and the exhaust guide. Typically, the engine comprises a number of exhaust valves 30 in fluid communication with the combustion chamber and configured to regulate the evacuation of exhaust gases from the combustion chamber. As will be further described herein, at least one of the exhaust valves is a flow control valve adapted to regulate the flow of a fluid medium passing through the flow control valve. In this example embodiment, each one of the exhaust valves is provided in the form of a flow control valve. That is, each exhaust valve 30 comprises a flow control valve 38 adapted to regulate the flow of a fluid medium passing through the flow control valve.

It should be readily appreciated that although the example embodiment above relates to a system in which each one of the inlet valves and each one of the exhaust valves is a flow control valve, it may be sufficient that only one of the inlet valves and the exhaust valve is a flow control valve. In other words, any one of the inlet valves and the outlet valves comprises at least one flow control valve 28, 38, and which is adapted to regulate the flow of a fluid medium passing through the flow control valve. As mentioned above, one example of a flow control valve is described in relation to FIG. 4 below. Typically, although not strictly necessary, the valve 28, 38 comprises the actuator 91 operatively connected to the valve member and configured to operate the valve member by means of a pneumatic pressure. Hence, in this example embodiment, the valve is a pneumatic flow control valve adapted to regulate the flow of the fluid medium passing through the flow control valve. The actuator is typically configured to control the opening and closure of the valve member at given point in time. By way of example, the actuator is typically configured to control the opening and closure of the valve member at given point in time by receiving a signal from a control unit or the like.

Figure 2A:
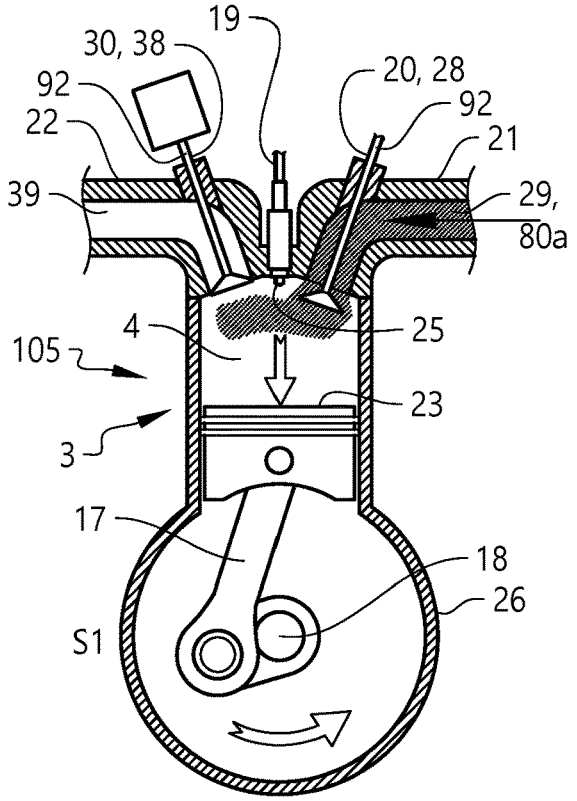
FIGS. 2*a*-2*i* schematically illustrate a number of operational steps in a method according to an example embodiment of the present invention.
Figure 2B:
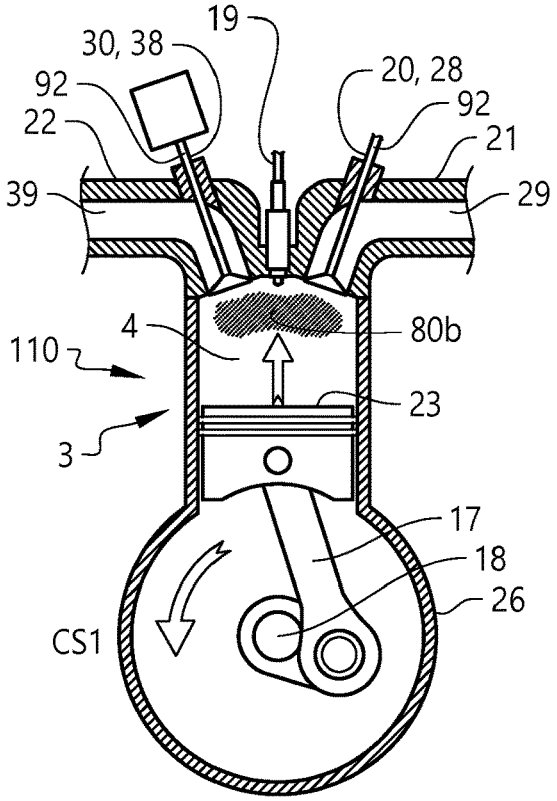
Figure 2C:
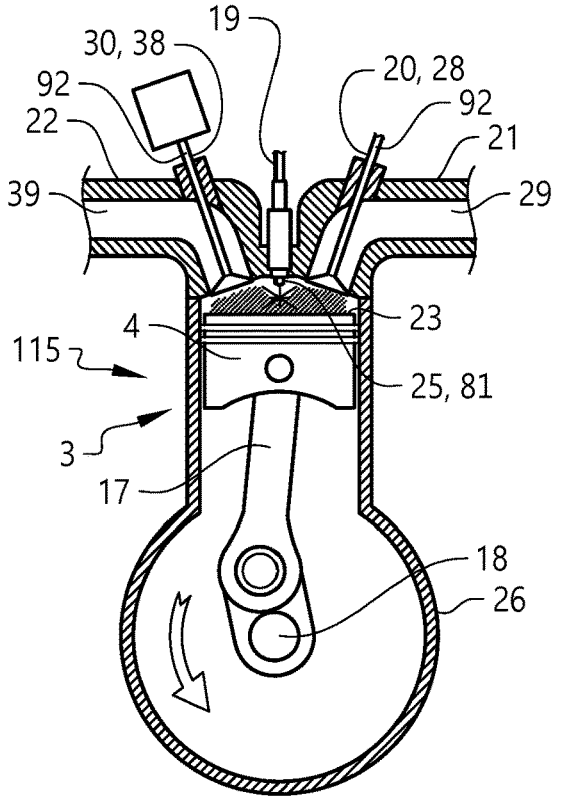
Figure 2D:
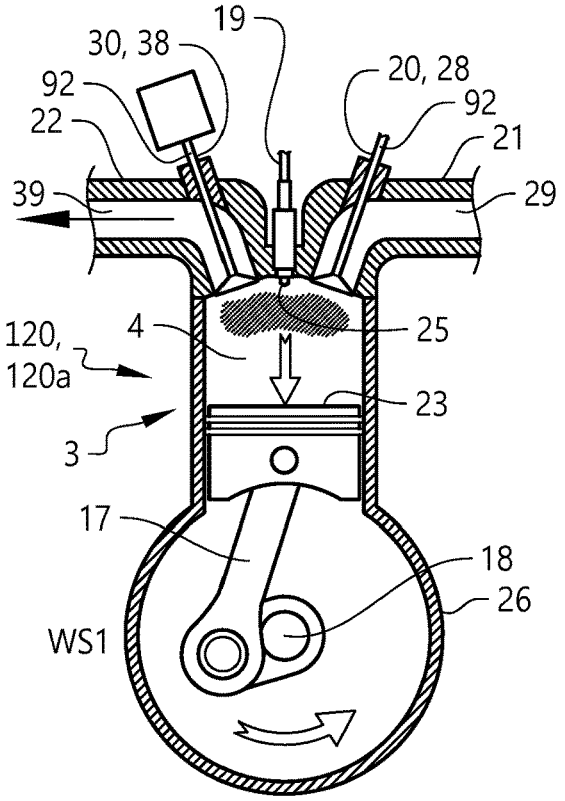
Figure 2E:
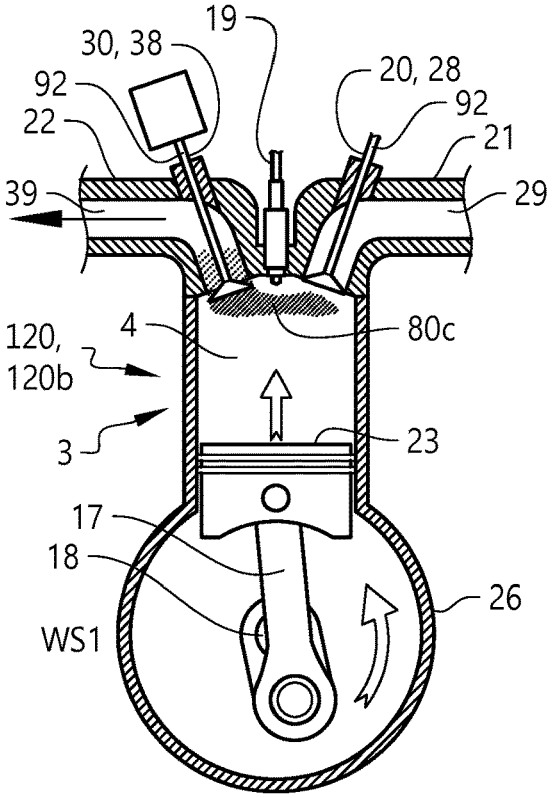
Figure 2F:
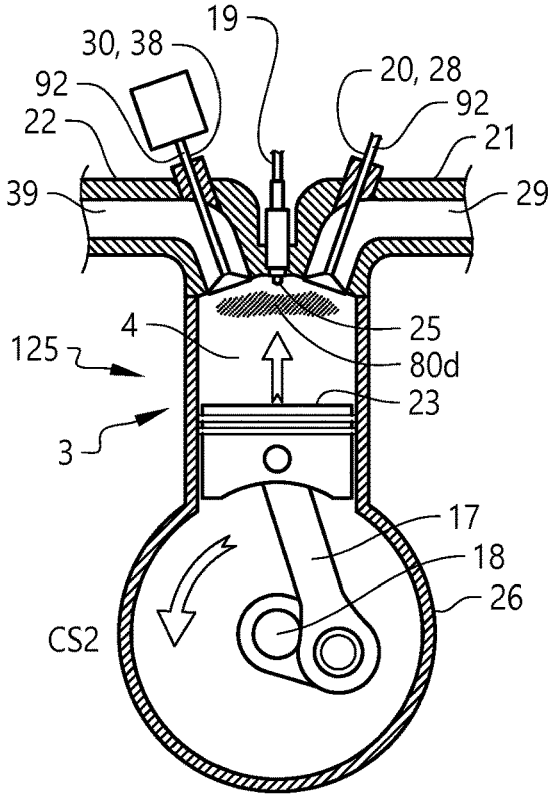
Figure 2G:
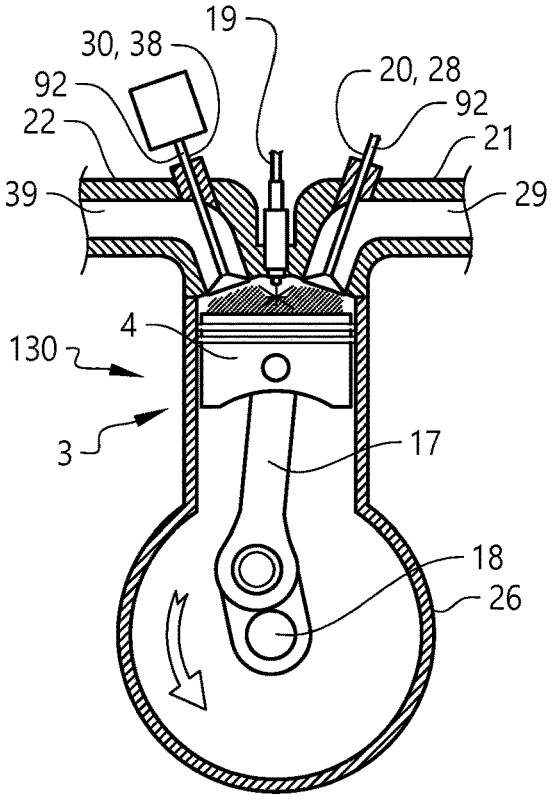
Figure 2H:
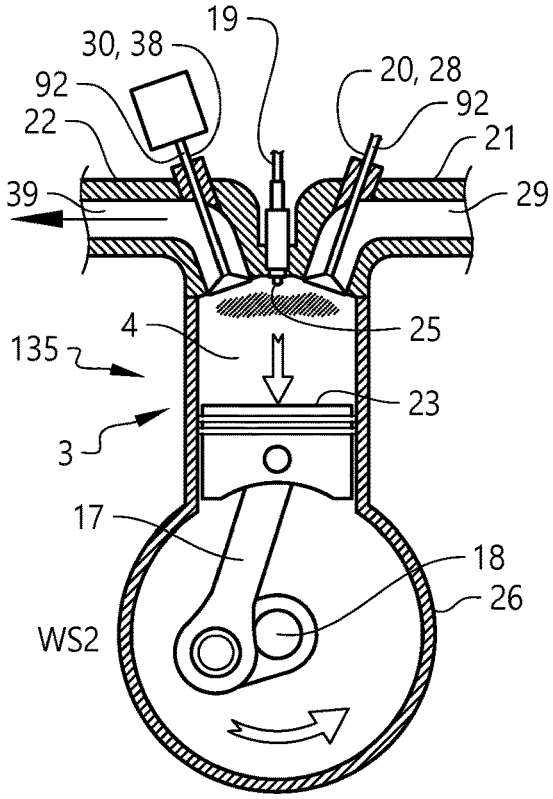
Figure 2I:
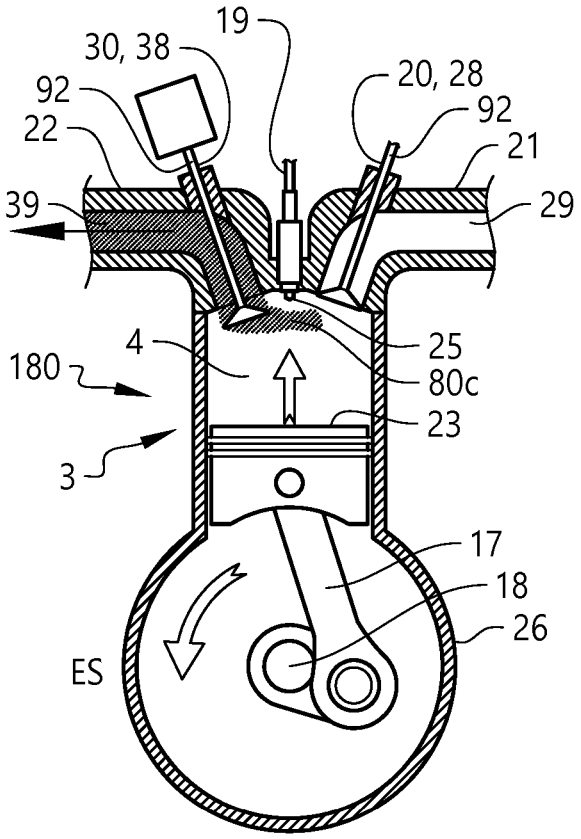
Figure 3:
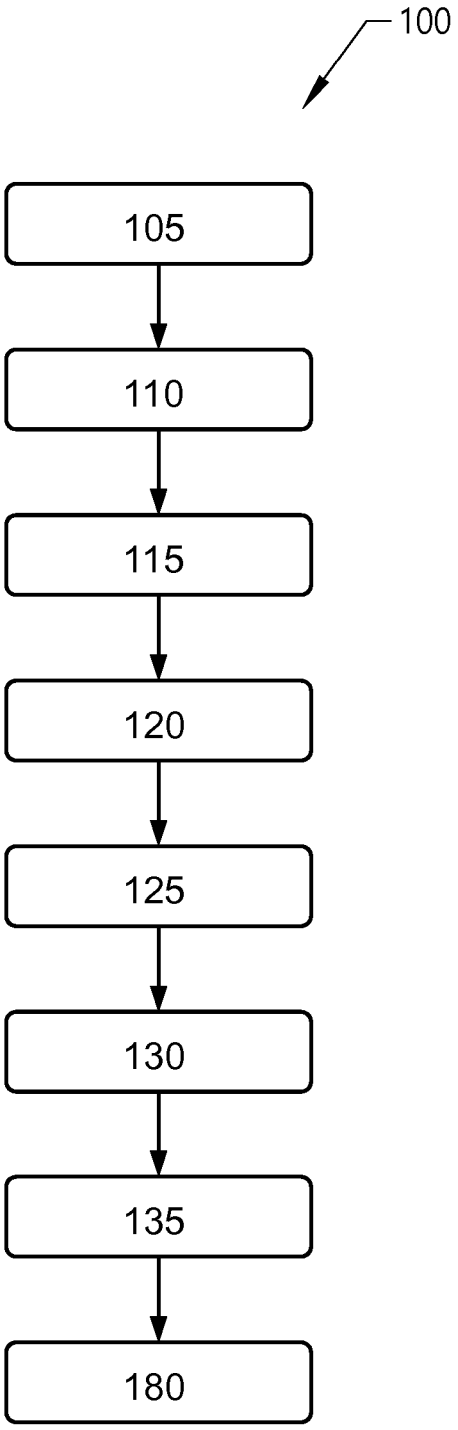
FIG. 3 is a block diagram depicting steps in a method according to an example embodiment of the present invention.

Turning now to the operation of the engine, the engine according to one example embodiment is arranged to provide in each cylinder 3 a so called extended repeated four-stroke cycle. That is, the sequence of the operation of the engine per cylinder is based on an extension of the sequences of a conventional four stroke cycle. One example embodiment of the sequences of a method adapted to operate the engine according to the present invention is depicted in the flowchart in FIG. 3. The state of the cylinder, piston and the valves for each sequence is depicted in the FIGS. 2*a*-2*i*. Hence, with reference to FIG. 3, there is provided a method for operating the engine, as described in relation to the FIGS. 1 and 2*a*-2*i*, with a sequence of an intake stroke S1, a first compression stroke CS1, a first work stroke WS1, a second compression stroke CS2, a second work stroke WS2 followed by an exhaust stroke ES. In particular, the method comprises the following steps:

opening 105 at least one of the inlet valves and introducing the incoming fluid medium into the cylinder 3 of the engine by performing the intake stroke S1 (FIG. 2*a*);

compressing 110 the trapped fluid medium in the first compression stroke CS1 of the cylinder 3, while having the number of the inlet valves and the number of the exhaust valves in a closed state (FIG. 2*b*);

injecting 115 a quantity of fuel into the cylinder 3 and combusting the injected fuel (FIG. 2*c*);

performing 120 the first work stroke WS1 to produce power to the crank shaft of the engine (FIG. 2*d*), while controlling the flow control valve to partly exhaust burnt gases at the end of the work stroke, thereby reducing the pressure in the cylinder (FIG. 2*e*);

additionally compressing 125 remaining fluid medium in the additional compression stroke CS2 of the cylinder 3, while having the number of the inlet valves and the number of the exhaust valves in a closed state (FIG. 2*f*);

additionally injecting 130 an additional quantity of fuel into the cylinder 3 (FIG. 2*g*);

additionally performing 135 the additional work stroke WS2 to produce power to the crank shaft of the engine, while controlling the flow control valve to partly exhaust burnt gases at the end of the additional work stroke, thereby reducing the pressure in the cylinder (FIG. 2*h*); and opening 180 at least one of the exhaust valves and permitting partly burnt gases to expel from the cylinder via the at least one exhaust valve by performing the exhaust stroke ES (FIG. 2*i*).

In this example embodiment, the cycle typically starts again at the intake stroke by opening 105 the inlet valves and introducing further incoming fluid medium into the cylinder 3 of the engine. However, it should be noted that the steps 125 to 135 are typically, although not strictly necessary, repeated in a cycle, and in a number of times. By way of example, step 125 to step 135 are repeated until the quantity of the remaining fluid medium in the cylinder is below a threshold value. The threshold value can be set in several different manners, and typically by the control unit 600. The number of repetition is also typically set and controlled by the control unit 600. The number of cycles (repetitions) until the remaining fluid medium is below the threshold value is typically dependent on the type of engine and type of fuel. The number of cycles (repetitions) until the remaining fluid medium is below the threshold value may typically also depend on the quantity of water in the fluid medium etc., which normally has an impact on the combustion of the fuel. By way of example, the number of cycles can be set or determined by measuring the characteristics of the burnt gases in previous cycles.

It should be readily appreciated that the incoming fluid medium is converted to the trapped fluid medium when the incoming fluid medium has been introduced into the cylinder of the engine. That is, the incoming fluid medium is trapped within the cylinder when it has been introduced in the cylinder. Hence, the term "trapped" as used herein refers to the fluid medium trapped in the cylinder of the engine. As such, the characteristics of the trapped fluid medium correspond to the characteristics of the incoming fluid medium. Thus, the trapped fluid medium may also be denoted as the trapped incoming fluid medium, or the incoming fluid being trapped in the cylinder.

Further, in the FIGS. 2*a*-2*i*. the incoming fluid medium is indicated by reference numeral 80*a*, the trapped fluid medium is indicated by reference numeral 80*b*, the injected fuel is indicated by reference 81, the burnt gases is indicated by reference numeral 80*c*, and the remaining fluid medium is indicated by reference numeral 80*d*.

As mentioned above, the engine can be provided in several different configurations including one or more flow control valve(s). The flow control valves are particularly useful in steps 120 and 135 so as to permit that the engine system can partly exhaust burnt gases at the end of the work stroke, which is illustrated in FIG. 2*e*. In addition, it should be readily appreciated that the step 120 can be considered as a step 120*a* (FIG. 2*d*), in which step 120*a* refers to the step of performing the first work stroke WS1 to produce power to the crank shaft of the engine, and a step 120*b*, in which the step 120*b* (FIG. 2*e*) refers to the step of controlling the flow control valve to partly exhaust burnt gases at the end of the work stroke, thereby reducing the pressure in the cylinder.

Also, it is to be noted that in the step of performing the first work stroke WS1 to produce power to the crank shaft of the engine, the exhaust flow control valve 38 is in the closed state. Accordingly, the number of the inlet valves 20 and the number of the exhaust valves 30 are maintained in their closed state, respectively, when performing the first work stroke WS1 to produce power to the crank shaft of the engine.

Analogously, the additional step 135 of performing the additional work stroke WS2 to produce power to the crank shaft of the engine, while controlling the flow control valve to partly exhaust burnt gases at the end of the additional work stroke, thereby reducing the pressure in the cylinder, may also be considered as a first sub-step "a" and a second sub-step "b" (although not shown in the Figures) similar to the step 120*a* and step 120*b*.

Also, it is to be noted that in the step of performing the additional work stroke WS2 to produce power to the crank shaft of the engine, the exhaust flow control valve 38 is in the closed state. Accordingly, the number of the inlet valves 20 and the number of the exhaust valves 30 are maintained in their closed state, respectively, when performing the additional work stroke WS2 to produce power to the crank shaft of the engine.

In one example embodiment, when only one of the inlet valves is a flow control valve, it should be readily appreciated that the steps 120 and 135 are performed in the following manner:

performing 120 the first work stroke WS1 to produce power to the crank shaft of the engine, while controlling the flow control inlet valve 28 to partly exhaust burnt gases at the end of the work stroke, thereby reducing the pressure in the cylinder;

additionally performing 135 the additional work stroke WS2 to produce power to the crank shaft of the engine, while controlling the flow control inlet valve 28 to partly exhaust burnt gases at the end of the additional work stroke, thereby reducing the pressure in the cylinder.

Analogously, in another design, when a number of inlet valves are flow control valves, or all inlet valves are flow control valves, the steps 120 and 135 are performed in the following manner:

performing 120 the first work stroke WS1 to produce power to the crank shaft of the engine, while controlling a number of, or all, flow control inlet valves 28 to partly exhaust burnt gases at the end of the work stroke, thereby reducing the pressure in the cylinder;

additionally performing 135 the additional work stroke WS2 to produce power to the crank shaft of the engine, while controlling a number of, or all, flow control inlet valves 28 to partly exhaust burnt gases at the end of the additional work stroke, thereby reducing the pressure within the cylinder.

In a similar vein, in another design, when only one of the exhaust valves is a flow control valve, it should be readily appreciated that the steps 120 and 135 are performed in the following manner:

performing 120 the first work stroke WS1 to produce power to the crank shaft of the engine, while controlling the flow control exhaust valve 38 to partly exhaust burnt gases at the end of the work stroke, thereby reducing the pressure in the cylinder;

additionally performing 135 the additional work stroke WS2 to produce power to the crank shaft of the engine, while controlling the flow control exhaust valve 38 to partly exhaust burnt gases at the end of the additional work stroke, thereby reducing the pressure in the cylinder.

Analogously, in another design, when a number of exhaust valves are flow control valves, or all exhaust valves are flow control valves, the steps 120 and 135 are performed in the following manner:

performing 120 the first work stroke WS1 to produce power to the crank shaft of the engine, while controlling a number of, or all, flow control exhaust valves 38 to partly exhaust burnt gases at the end of the work stroke, thereby reducing the pressure in the cylinder;

additionally performing 135 the additional work stroke WS2 to produce power to the crank shaft of the engine, while controlling a number of, or all, flow control exhaust valves 38 to partly exhaust burnt gases at the end of the additional work stroke, thereby reducing the pressure in the cylinder.

Also, it would be conceivable to combine the difference designs of the valve combinations as mentioned above. For instance, the system may comprise one flow control inlet valve 28 and one flow control exhaust valve 38. In another design variant, the system comprises a number of flow control inlet valves 28 and a number of flow control exhaust valves 38. In other words, several different inlet and exhaust valves combinations are conceivable in accordance with the present invention.

As mentioned above, the flow control valves are typically controllable by the control unit 600.

With respect to the other method steps, e.g. 105, 125 and 180, the inlet and outlet valves are controlled so as to switch between an open and closed state. Hence, one or several numbers of the valves may be provided in the form of one or several conventional valve(s) controllable by the control unit. As an example, one or several numbers of the valve(s) may be poppet type valve(s).

Accordingly, as depicted in FIG. 2*a*, when the piston 23 moves towards its bottom dead center (BDC) position in the intake stroke, corresponding to step 105, at least one of the inlet valves 30 is kept open and fluid medium (e.g. air) is introduced to the cylinder 3 of the engine. In this suction stroke or intake stroke of the engine, the piston 23 starts moving from top end of the cylinder to bottom end of the cylinder, while the inlet valve is kept in its opened position.

Afterwards, the corresponding open inlet valve is closed to seal the upper end of the cylinder. Hence, in the following sequence, step 110 as depicted in FIG. 2*b*, each one of the number of the inlet valves and the number of the exhaust valves are kept in the closed state, such that the compression of the air is performed in the first compression stroke CS1 by having the valves in the closed state. By moving the piston upwards to the top dead center position, the piston compresses the air into a small space between the top of the piston and cylinder head. Due to this compression, a high pressure and a high temperature is generated inside the cylinder. To this end, the step 110 of compressing the trapped (incoming) air medium in the first compression stroke CS1 of the cylinder 3 is generally performed by displacing the piston 23 from bottom dead center of the cylinder to top dead center of the cylinder. Further, both the inlet and exhaust valves do not open during any part of this stroke. In this manner, it becomes possible to increase the pressure in the cylinder In step 115, when the piston 23 reaches the TDC position at the end of the first compression stroke CS1, a quantity of fuel is injected into the cylinder 3, which is depicted in FIG. 2*c*. The injected fuel is ignited and combusted within the cylinder. In other words, at the end of the first compression stroke CS1, when the piston is at the top end of the cylinder, a metered quantity of diesel is injected into the cylinder by the injector, as described above. The heat of the compressed air ignites the diesel fuel and generates a high pressure, which pushes down the piston.

The connection rod carries this force to the crankshaft which turns to move the vehicle. That is, in step 120, when the compressed air has ignited the diesel fuel, the first work stroke WS1 is performed to produce power to the crank shaft of the engine (FIG. 2*d*), while controlling the flow control valve 28 and/or 38 to partly exhaust burnt gases at the end of the work stroke (FIG. 2*e*). Step 120 of the cycle is depicted in e.g. FIGS. 2*d*-2*e*. In this manner, the pressure in the cylinder is partly reduced. At the end of the first work stroke WS1, the piston reaches the bottom end of the cylinder, which is depicted in FIG. 2*e*.

Accordingly, in this sequence in step 120, exhaust gases produced are partly expelled from the cylinder 3 by means of the flow control valves 28, 38. In this example embodiment, the step of partly exhausting the burnt gases at the end of the work stroke is performed close to or at the bottom dead center. Typically, although strictly not required, the step of partly exhausting the burnt gases at the end of the work stroke is performed close to or at the bottom dead center, and at sonic flow.

By means of the control of the flow control valves 28, 38 in step 120, it becomes possible to control the discharge of exhaust gases during the work stroke in a more efficient manner, thus allowing an improved control and operation of the combustion cycle of the engine. In addition, it becomes possible to continue with additional compression of the remaining fluid medium in an additional compression stroke, corresponding to step 125, which is depicted in FIG. 2*f*. The remaining fluid medium typically contains a mixture of air and exhaust gases. The remaining fluid medium may sometimes be referred to as a remaining oxidizing agent. In other words, in step 125, each one of the number of the inlet valves and the number of the exhaust valves are again kept in their closed state, such that the compression of the remaining fluid medium is performed in the second compression stroke CS2 by having the valves in their closed state. Similar to sequence in step 110, the piston compresses the remaining fluid medium into a small space between the top of the piston and cylinder head, by moving the piston upwards to the top dead center position. Due to this additional compression, a higher pressure and temperature is again generated inside the cylinder. Further, both the inlet and exhaust valves do not open during any part of this stroke. In this manner, it becomes possible to again increase the pressure in the cylinder by compressing the remaining fluid medium.

Step 125 is followed by an additional injection of fuel, which corresponds to step 130 above and depicted in FIG. 2*g*. That is, in step 130, an additional quantity of diesel fuel is injected into the cylinder 3. The additional injected quantity of fuel is combusted in a similar vein as mentioned above in step 115. As shown in FIG. 2*g*, the piston 23 again reaches the TDC position at the end of the additional compression stroke CS2, whereby an additional quantity of fuel is injected into the cylinder 3 followed by a combustion of the additional fuel. As in step 115, the heat of the remaining fluid medium ignites the diesel fuel and generates a high pressure that pushes down the piston towards the BDC.

Accordingly, the connection rod carries this force to the crankshaft which turns to further move the vehicle. That is, in step 135, when the compressed remaining fluid medium has ignited the diesel fuel, the additional (or second) work stroke WS2 is performed to produce further power to the crank shaft of the engine, while controlling the flow control valve 28 and/or 38 to partly exhaust burnt gases at the end of the additional work stroke. Step 135 of the cycle is depicted in e.g. FIG. 2*h*. In this manner, the pressure in the cylinder can again be reduced. At the end of the additional work stroke WS2, the piston again reaches the bottom end of the cylinder. Also, in this sequence in step 135, exhaust gases produced in the stroke are partly expelled from the cylinder 3 by means of the flow control valves 28, 38. In this example embodiment, the step of partly exhausting the burnt gases at the end of the work stroke is performed close to or at the bottom dead center, and typically at sonic flow.

By means of the control of the flow control valves 28, 38 in step 135, it becomes possible to control the discharge of burnt gases during the additional work stroke in a more efficient manner. After the additional work stroke in step 135, the operational cycle either continues with repeating part of the sequences as mentioned above, i.e. continuing by repeating the steps 125 to 135 or moving on to the exhaust stroke ES in step 180, and as depicted in FIG. 2*i*, to perform a gas exchange. In step 180, at least one of the exhaust valves 130 is opened so that burnt gases are permitted to expel from the cylinder via the opened exhaust valve(s) by performing the exhaust stroke ES. That is, when the piston reaches the bottom end of cylinder after the additional work stroke, one or several exhaust valve(s) are set to an open state. The piston 23 once again returns from the BDC to the TDC, while keeping the exhaust valve(s) open. At this time, the exhaust gases inside the cylinder can expel or escape from the cylinder through the opened exhaust valve(s). At the end of the exhaust stroke, typically all burnt gases have escaped and the exhaust valve(s) are controlled to switch into the closed state. After the exhaust stroke ES, the cycle typically starts again at the intake stroke S1, as mentioned above.

Moreover, the example embodiments of the present invention can permit to use the burnt gases in step 120 and/or in step 135 to propel a turbo charger (although not shown). Hence, in some design variants of the engine system, the engine comprises a turbocharger. The turbocharger may comprise a turbine for extracting power from exhaust gases from the cylinder to drive a compressor for charging air to be guided to the cylinder. In this type of engine system, the method according to one example embodiment comprises the step of using the burnt gases in the step 120 to propel the turbo charger. In addition, or alternatively, the method comprises the further step of using the burnt gases in the step 135 to propel the turbo charger.

Figure 4:
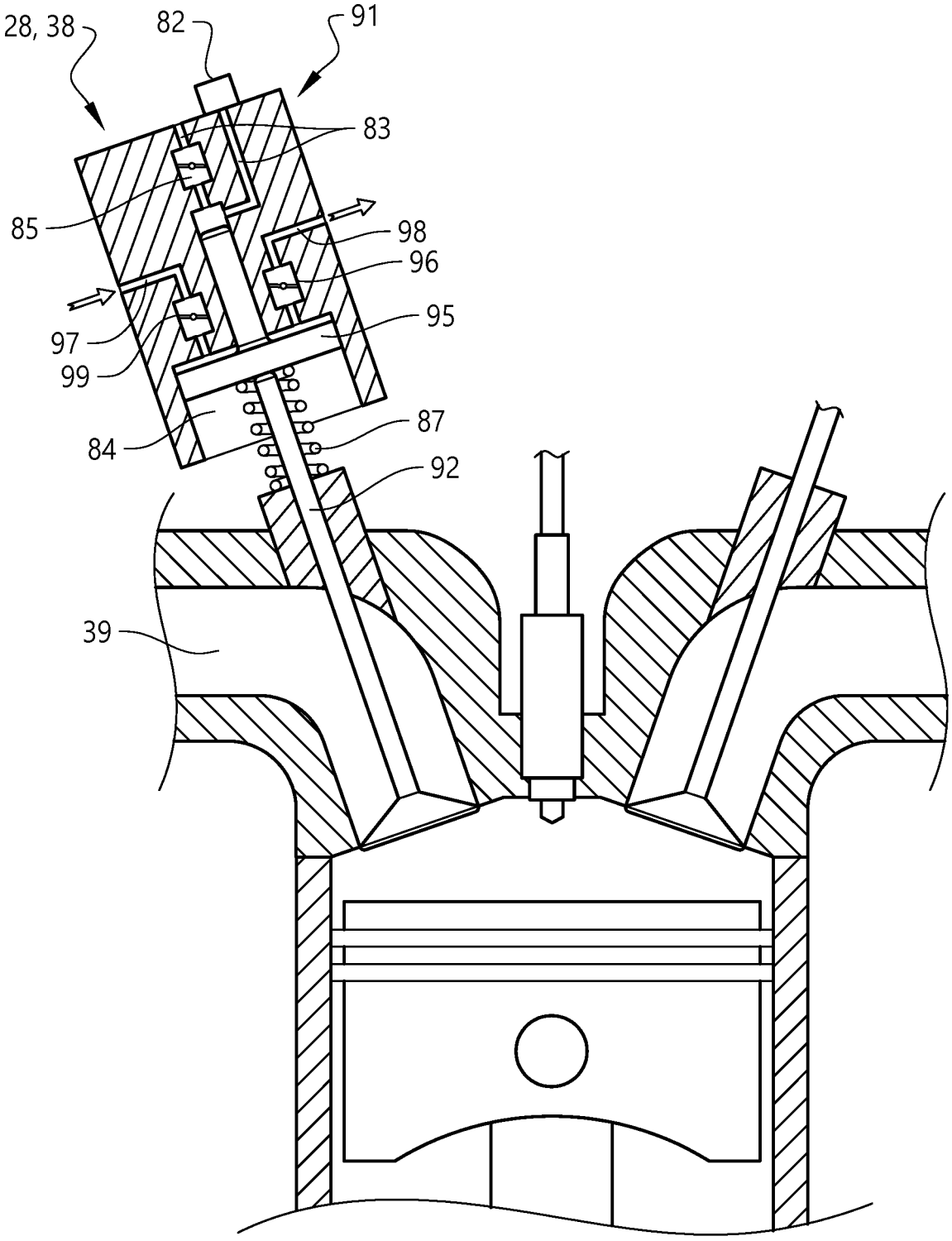
FIG. 4 schematically illustrates parts of an example of a flow control valve, which is intended for controlling a flow of a fluid medium in an internal combustion engine system.

Turning again to the step 120 and the step 135, it should be noted that the flow control valve 28, 39 can be controlled in several different manners, as is also described in relation to FIG. 4. Typically, the step of partly exhausting burnt gases at the end of the first work stroke WS1 is performed by controlling a valve parameter relating to any one of valve opening size, valve opening timing, valve opening duration or a combination thereof. The parameter may also refer to any one of the flow area, flow time, valve lift or a combination thereof.

In the example embodiment described in relation to FIGS. 2*a*-2*i* and FIG. 3, the step of partly exhausting burnt gases at the end of the first work stroke WS1 is performed by controlling a flow area of one flow control inlet valve 28. The flow area may refer to any one of the effective flow area or an estimated flow area for a given fluid medium with a given density and with a given flow velocity. The flow area is typically controlled by regulating the lift height of the valve and the duration of the openness of the flow control valve.

In one design variant, the step of partly exhausting burnt gases at the end of the first work stroke WS1 is performed by controlling the flow area of one flow control exhaust valve 38.

Analogously, in the example embodiment described in relation to FIGS. 2*a*-2*i* and FIG. 3, the step of partly exhausting burnt gases at the end of the additional work stroke WS2 is performed by controlling the flow area of one flow control inlet valve 28.

In a similar vein, in one design variant, the step of partly exhausting burnt gases at the end of the additional work stroke WS2 is performed by controlling the flow area of one flow control exhaust valve 38.

Moreover, as mentioned above, the internal combustion engine may comprise one or a number of flow control valve(s). In the example embodiment described in relation to FIGS. 2*a*-2*i* and FIG. 3, the step of partly exhausting burnt gases at the end of the first work stroke WS1 is illustrated to be performed by utilizing only one flow control valve of the group of the exhaust valves and the group of intake valves. Analogously, the step of partly exhausting burnt gases at the end of the additional work stroke WS2 is illustrated to be performed by utilizing only one flow control valve of the group of the exhaust valves and the group of intake valves.

In one design variant, the step of partly exhausting burnt gases at the end of the first work stroke WS1 is performed by utilizing a number of the flow control exhaust valves 38 in the group of the exhaust valves 28. Analogously, the step of partly exhausting burnt gases at the end of the additional work stroke WS2 is performed by utilizing a number of the flow control exhaust valves 38 in the group of the exhaust valves 28.

In another design variant, the step of partly exhausting burnt gases at the end of the first work stroke WS1 is performed by utilizing each one of the flow control exhaust valves 38 in the group of the exhaust valves 28. Analogously, the step of partly exhausting burnt gases at the end of the additional work stroke WS1 is performed by utilizing each one of the flow control exhaust valves 38 in the group of the exhaust valves 28.

Turning again to the parts of the flow control valve 28, 38, which can be arranged as an inlet valve 20 or as an exhaust valve 30 in several different ways, one example of a flow control valve is depicted in FIG. 4. The flow control valve described in relation to FIG. 4 is one conceivable example embodiment of the flow control valve intended for the system and the method as described herein in relation to the FIGS. 1, 2*a*-2*i* and 3.

The flow control valve 28, 38 can be controlled in various manners. Typically, although not strictly necessary, the valve comprises the actuator 91 operatively connected to the valve member 92. The actuator is typically configured to control the opening and closure of the valve member at a given point in time. By way of example, the actuator is typically configured to control the opening and closure of the valve member at a given point in time by receiving a signal from a control unit or the like. The valve member is here a lift type valve member. By way of example, the lift type member can be a conventional poppet valve or the like, as shown in FIGS. 1*b* and 4. However, the valve member may likewise be provided as a rotational type valve member, a slide valve member, a seat valve member or the like. The actuator of the valve is configured to operate the valve member 92 by pneumatic pressure. As such, the valve member 92 is a pressure activated valve member. In this example, each one of the flow control valves 28, 38 comprises a pneumatic actuator operatively connected to a corresponding valve member.

In particular, as shown in FIG. 4, the actuator 91 of the valve is configured to operate the valve member via an actuator piston 95. The actuator 91 is in fluid communication with a pressurized air medium (not shown) via an air inlet 97 and an air outlet 98. In this manner, the pneumatic valve actuation utilizes compressed air to control the valve opening of the valve member, i.e. to operate the valve member between an open fluid medium state and a closed fluid medium state. Accordingly, the actuator comprises at least the air inlet 97 for the pressure fluid medium and at least the air outlet 98 for the pressure fluid medium. The pressurized air flowing in via the air inlet 97 is directed towards the actuator piston 95 by a means of an air inlet valve 99. The air inlet valve 99 is disposed in the air inlet and configured to open and close the air inlet so as to control the flow of air to the actuator piston 95. Further, there is disposed an air outlet valve 96 in the air outlet 98, which is configured to open and close the air outlet in order to permit air to discharge from the actuator. Typically, as shown in FIG. 4, the actuator piston 95 is disposed in a chamber 84 defining a space for a reciprocating movement of the actuator piston 95. The actuator piston 95 is operable between a first position (an upper position), in which the valve member 92 is in the closed state, and a second position (a lower position), in which the valve member 92 is in the open state. In FIG. 4, the actuator is in the upper position, i.e. in the closed state. The actuator piston 95 is operable between the first position (upper position) and the second position (lower position) by pressurizing and depressurizing the actuator. In addition, the flow control valve comprises a spring 87 arranged in-between the valve member 92 and the actuator piston disc 95 so as to return the valve member to its original position, i.e. corresponding to the upper position of the actuator piston disc 95.

The flow control valve may also have a hydraulic circuit 83 comprising a hydraulic circuit chamber. The purpose of the hydraulic circuit is to further control or dampening the movement of the actuator piston disc 95. The hydraulic circuit can be controlled by the hydraulic valve 85.

Moreover, the flow control valve can include a control valve unit 82 to control the operation of the flow control valve upon a signal from the control unit 600. By way of example, the actuator 91 is configured to operate upon the signal received from the control unit 600 to the control valve unit 92. The control valve unit may also include a sensor arrangement or the like to monitor the various components of the flow control valve. Also, the control valve unit 82 is typically configured to control the various components of the flow control valve, as mentioned above. It is to be noted that the flow control valve can be provided in several different designs, and may also include additional components than the ones described above. Thus, the above example of the flow control valve is only one example of a valve suitable for being incorporated in the method of the example embodiments described herein.

In the example when the flow control valve comprises the actuator and the valve member, the step of partly exhausting burnt gases at the end of the work stroke is performed by controlling the actuator 91 which is operatively connected to the valve member 92 of the flow control valve. The valve member 92 is adapted to control and adjust at least one of the fluid medium passages 29, 39 (as shown in FIG. 1*a*) in response to the operation of the actuator 91.

Further, as mentioned above, the flow control valve is configured to control a valve parameter relating to any one of valve opening size, valve opening timing, valve opening duration, flow area, flow time, valve lift or a combination thereof. Typically, although strictly not necessary, the step of partly exhausting burnt gases at the end of the work stroke (either the first work stroke or an additional work stroke) is performed by controlling the actuator 91 of the valve, which is operatively connected to the valve member 92 of the valve, so that the valve member adjust the flow area in order to exhaust a portion of exhaust gases at the end of the work stroke. The valve member is adapted to regulate the valve opening 93 upon a signal from the actuator, which is typically generated by the control unit.

It should also be noted that although the example embodiments described above in relation to the FIGS. 1*a*-1*b*, 2*a*-2*i*, 3 and 4 are based on using air as the incoming fluid medium, the internal combustion engine system may in other configurations use a mixture of air and another gas, or only another type of gas. Also, in other design variants, the incoming fluid medium may be a liquid fluid medium, e.g. water, or an aerosol and the like. Thus, the example embodiments of the invention should not be regarded as limited to air as the fluid medium.

Also, it should be noted that the step 115 of injecting a quantity of fuel into the cylinder 3 and combusting the injected fuel is typically, although not strictly necessary, a parallel operational process to the step 110 of compressing the fluid medium. Thus, in many engines, the step 115 is initiated at the end of step 110. In a similar vein, the step 130 of injecting an additional quantity of fuel into the cylinder 3 is typically a parallel operational process to the step 123 of compressing the remaining fluid medium in the additional compression stroke CS2.

In view of the above, there is described various example embodiments of a method 100 for operating the internal combustion engine 2 of the vehicle 1. The engine 2 comprises the engine cylinder 3 at least partly defining the combustion chamber 4 and the reciprocating piston 5 operable between the bottom dead center and the top dead center.

The engine further comprises the number of inlet valves 20 in fluid communication with the combustion chamber and configured to regulate the supply of the incoming fluid medium to the combustion chamber and the number of exhaust valves 30 in fluid communication with the combustion chamber and configured to regulate the evacuation of exhaust gases from the combustion chamber. Moreover, any one of the inlet valves and the outlet valves comprises at least one flow control valve 28, 39 adapted to regulate the flow of a fluid medium passing through the flow control valve. This type of method comprises the steps as described above in any one of the example embodiments, and is typically controlled by the control unit 600. Thus, the internal combustion engine typically comprises the control unit 600 for controlling the internal combustion engine. Further, the control unit 600 is configured to perform the steps of the method according to any one of example embodiments as described above.

The example embodiments of the invention also relates to the vehicle comprising the internal combustion engine and the control unit. In addition, the example embodiments of the invention relates to a computer program comprising program code means for performing the steps of any one of the example embodiments as described above when the program is run on a computer. Further, the example embodiments of the invention relates to a computer readable medium carrying a computer program comprising program means for performing the steps of any one of the example embodiments when the program means is run on a computer.

It is to be understood that the present invention is not limited to the embodiments described above and illustrated in the drawings; rather, the skilled person will recognize that many changes and modifications may be made within the scope of the appended claims.

The invention claimed is:

1. A method for operating an internal combustion engine such as an internal combustion engine of a vehicle, the engine comprising an engine cylinder at least partly defining a combustion chamber and a reciprocating piston operable between a bottom dead center and a top dead center, a number of inlet valves in fluid communication with the combustion chamber and configured to regulate the supply of an incoming fluid medium to the combustion chamber and a number of exhaust valves in fluid communication with the combustion chamber and configured to regulate the evacuation of exhaust gases from the combustion chamber, wherein any one of the inlet valves and the outlet valves comprises at least one flow control valve adapted to regulate the flow of a fluid medium passing through the flow control valve, characterized by the method comprising the following steps:

opening at least one of the inlet valves and introducing the incoming fluid medium into the cylinder of the engine by performing an intake stroke;

compressing the trapped incoming fluid medium in a first compression stroke of the cylinder, while having the number of the inlet valves and the number of the exhaust valves in a closed state;

injecting a quantity of fuel into the cylinder and combusting said injected fuel, resulting in burnt gases and remaining fuel medium;

performing a first work stroke to produce power to a crank shaft of the engine, while controlling said flow control valve to partially exhaust the burnt gases at the end of the work stroke, thereby reducing the pressure in the cylinder, resulting in an exhausted first portion of the burnt gases and a remaining second portion of the burnt gases;

compressing the remaining fluid medium in an additional compression stroke of the cylinder, while having the number of the inlet valves and the number of the exhaust valves in a closed state;

injecting an additional quantity of fuel into the cylinder, resulting in a mixture of the additional quantity of fuel, the remaining fluid medium, and the remaining second portion of the burnt gases;

combusting the mixture of the additional quantity of fuel, the remaining fluid medium, and the remaining second portion of the burnt gases;

performing an additional work stroke to produce power to the crank shaft of the engine, while controlling said flow control valve to partially exhaust burnt gases due to combustion of the mixture at the end of the additional work stroke, thereby reducing the pressure in the cylinder;

repeating the steps of additionally compressing remaining fluid medium in an additional compression stroke of the cylinder, while having the number of the inlet valves and the number of the exhaust valves in a closed state, additionally injecting an additional quantity of fuel into the cylinder, and additionally performing an additional work stroke to produce power to the crank shaft of the engine, while controlling the flow control valve to partly exhaust burnt gases at the end of the additional work stroke, thereby reducing the pressure in the cylinder, until the quantity of the remaining fluid medium in the cylinder is below a threshold value; and opening at least one of the exhaust valves and permitting partly burnt gases to expel from the cylinder via said at least one exhaust valve by performing an exhaust stroke.

2. Method according to claim 1, characterized by the step of partly exhausting burnt gases at the end of the work stroke being performed close to or at the bottom dead center.

3. Method according to claim 1, characterized by using said burnt gases in said step to propel a turbo charger.

4. Method according to claim 1, characterized by the step of partly exhausting burnt gases at the end of the work stroke being performed by controlling a valve parameter relating to any one of valve opening size, valve opening timing, valve opening duration, flow area, flow time, valve lift or a combination thereof.

5. Method according to claim 1, characterized by the step of partly exhausting burnt gases at the end of the work stroke being performed by utilizing only one flow control valve of the group of the exhaust valves and the group of intake valves.

6. Method according to claim 1, characterized by each one of the valves of the group of exhaust valves being a flow control valve, said step of partly exhausting burnt gases at the end of the work stroke being performed by utilizing each one of the flow control valves in the group of the exhaust valves.

7. Method according to claim 1, characterized by the flow control valve being any one of an electro-magnetic flow control valve, a pneumatic flow control valve, an electro-pneumatic flow control valve, a hydraulic flow control valve, an electro-hydraulic flow control valve or the like.

8. Method according to claim 1, characterized by the step of partly exhausting burnt gases at the end of the work stroke being performed by controlling an actuator operatively connected to a valve member of said flow control valve, said valve member being adapted to regulate a valve opening upon a signal from said actuator.

9. Method according to claim 8, characterized by said valve member being any one of a rotational valve member and a lift valve member.

10. Method according to claim 1, characterized by said intake stroke comprising the step of displacing said piston from the top dead center of the cylinder to the bottom dead center of the cylinder, while maintaining at least one inlet valve open during at least a part of the time the piston being displaced from the top dead center to the bottom dead center.

11. Method according to claim 1, characterized by said step of compressing the trapped incoming fluid medium in said first compression stroke of the cylinder being performed by displacing said piston from bottom dead center of the cylinder to top dead center of the cylinder.

12. An internal combustion engine comprising a control unit for controlling said internal combustion engine, characterized in that the control unit is configured to perform the steps of the method according to claim 1.

13. A vehicle comprising an internal combustion engine and a control unit according to claim 12.

14. A computer program comprising program code means for performing the steps of claim 1 when said program is run on a computer.

* * * * *